United States Patent [19]

Clemens et al.

[11] Patent Number: 5,005,904

[45] Date of Patent: Apr. 9, 1991

[54] SYSTEM FOR INFLATING SUPPORT BAG IN SEAT

[75] Inventors: Clive Clemens, Etwall; Gary Martin, Burton-on-Trent, both of England

[73] Assignee: Pirelli Limited, London, England

[21] Appl. No.: 315,656

[22] Filed: Feb. 27, 1989

[30] Foreign Application Priority Data

Mar. 1, 1988 [GB] United Kingdom ..... 8804864

[51] Int. Cl.[5] ..... A47C 7/46

[52] U.S. Cl. ..... 297/284; 297/DIG. 3; 141/114; 417/12; 417/44

[58] Field of Search ..... 297/284, DIG. 3, 460; 137/565; 417/12, 44; 141/114, 313, 317

[56] References Cited

U.S. PATENT DOCUMENTS

| | | | |
|---|---|---|---|
| 4,570,676 | 2/1986 | Nishio et al. | 297/284 |
| 4,589,695 | 5/1986 | Isono | 297/284 |
| 4,634,179 | 1/1987 | Hashimoto et al. | 297/284 |
| 4,707,027 | 11/1987 | Horvath et al. | 297/284 |
| 4,840,425 | 6/1989 | Noble | 297/284 |

FOREIGN PATENT DOCUMENTS

| | | | |
|---|---|---|---|
| 245113 | 10/1987 | Japan | 417/12 |
| 245114 | 10/1987 | Japan | 417/12 |

*Primary Examiner*—Peter R. Brown

*Attorney, Agent, or Firm*—Scrivener and Clarke

[57] ABSTRACT

A system for inflating e.g. a pair of lumbar support bags of a vehicle seat comprises two pumps each connected to a respective bag and controlled by a common electronic control system. The control system causes each bag to be inflated over a period of between 1 and 10 minutes, the inflation of one bag taking place while the other bag is deflated and vice versa to produce alternating pressure zones in the lumbar region. Inflation of each bag is produced by a multiplicity of individual spaced apart energizations of the associated pump. The duration and spacing of the energizations is variable to produce the desired complete inflation of a bag within the required period. In the preferred embodiment the duration of each energization is preset during manufacture of the system but the spacing of the energizations is under the control of the user of the seat to vary the duration of the inflate/deflate cycle.

12 Claims, 1 Drawing Sheet

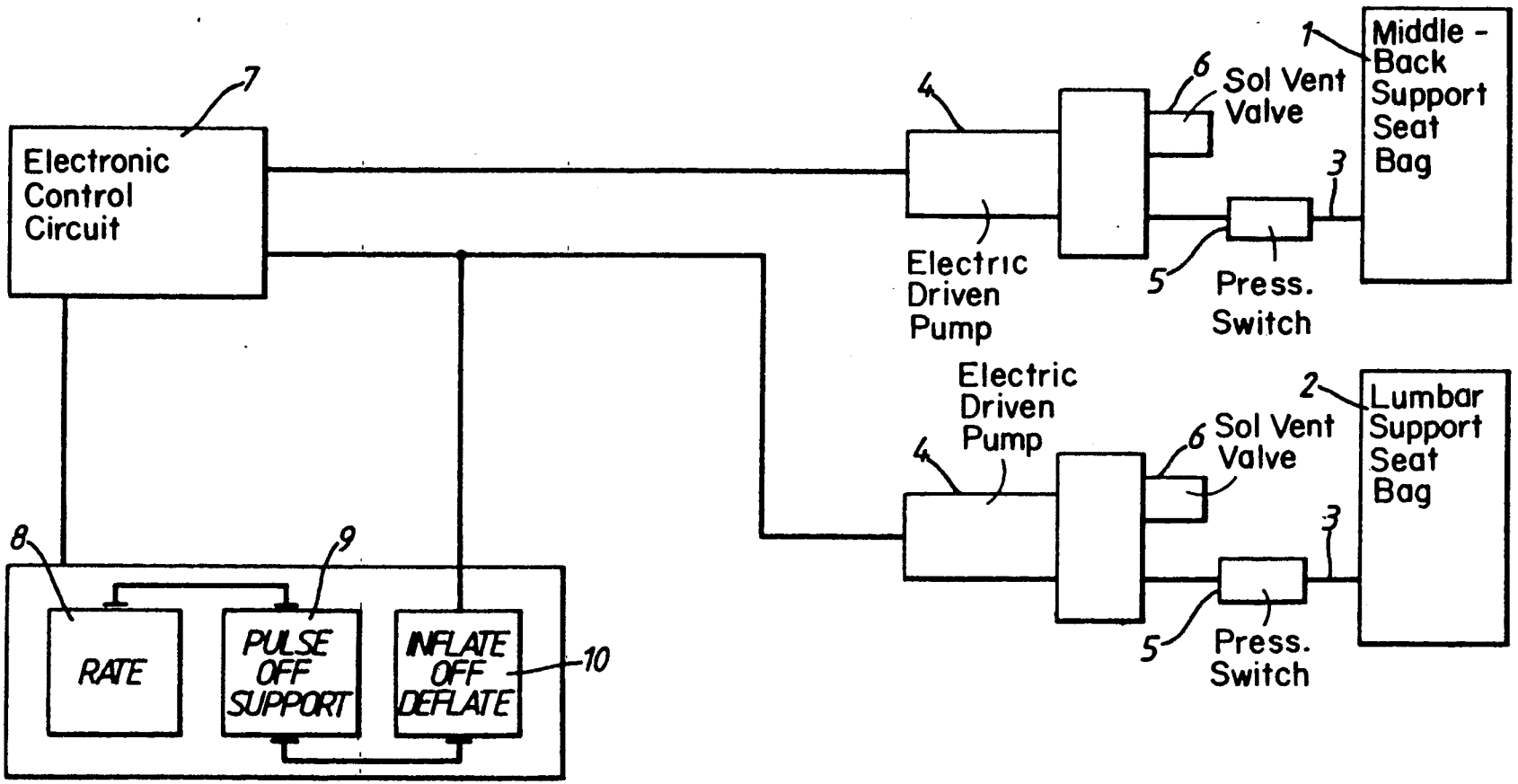
Middle - Back Support Seat Bag
1
Sol Vent Valve
6
3
Press. Switch
5
4
Electric Driven Pump
Lumbar Support Seat Bag
2
Sol Vent Valve
6
3
Press. Switch
5
4
Electric Driven Pump
7
Electronic Control Circuit
10
INFLATE OFF DEFLATE
9
PULSE OFF SUPPORT
8
RATE

SYSTEM FOR INFLATING SUPPORT BAG IN SEAT

This invention relates to a system for inflating a support bag in a seat, and in the preferred embodiment provides a system suitable for producing a continuous inflation-deflation cycle for a support bag forming part of a vehicle seat.

It has been proposed to incorporate within the seat of a vehicle a bag which is periodically inflated and deflated to apply a pulsating pressure to the occupant of the seat for the purpose of relieving discomfort induced by remaining seated for prolonged periods. It has further been proposed to incorporate within seats two or more such bags which are inflated and deflated in accordance with a predetermined sequence whereby one or more bags are inflated whilst one or more bags are deflated. Such proposals are contained, for example, in GB-A-633722, GB-A-1475799, and GB-A-2144984.

In implementing such a system it has been found desirable to inflate each bag (or group of bags, if several bags are inflated together) from the fully deflated state to a fully inflated state progressively over a period of at least one minute. The most desirable time interval for changing any bag from fully deflated to fully inflated will depend on the particular occupant of the seat and, for any particular occupant, may vary from time to time. It is accordingly desirable to provide an inflation system which will allow at least one bag to be inflated progressively from a fully deflated to a fully inflated state over a period selectable by the user of the seat, the period being in excess of 1 minute.

Providing a compact and reasonably priced inflation system, which will meet these requirements has proved difficult, especially if the inflation system is for use in a vehicle seat. It is clearly desirable to use compressed air as the inflation medium, in which case the air must be supplied either direct from a compressor, or from a reservoir. The use of a reservoir is unacceptable because of the space and weight requirements for such a reservoir, and in any event it would be difficult to provide reliable, and repeatable controlled metering of compressed air from a reservoir at the low average flow rate necessary to produce complete inflation of the bag in a period of between 1 and 10 minutes.

Accordingly, a motor driven compressor must be used. However, this in itself presents considerable practicable difficulties since the compressor must be small so as to be readily incorporated within the vehicle, quiet, lightweight so as not to add excessively to the weight of the vehicle, able to produce a small but variable output so as to meet the requirement for complete inflation during a period selectable by the user from 1 minute to 10 minutes, capable of operating under a wide range of temperature conditions during the entire period that the vehicle is in use, and have a life expectancy of at least 10 years in order to meet a typical vehicle manufacturers requirements.

Attempts to meet all these criteria with a conventional electrically driven compressor have failed.

According to one aspect of the present invention there is provided an inflation system for inflating a bag which is part of a seat structure, the system comprising: an electrically driven pump for supplying inflation fluid to the bag; and a control circuit for automatically energizing the pump at spaced apart intervals, the duration of each period of energization being such that the ouput of the pump during each period of energization produces only a small increase in the inflation of the bag whereby a multiplicity of periods of energization is required to produce complete inflation of the bag.

The preferred embodiment of the invention can meet all the design criteria set out above. The pump can be driven at vehicle battery voltages and can be designed for optimum weight, cost, quietness and life expectancy. Having designed a pump to meet these criteria, it will produce a volumetric output, if run continuously, sufficient to inflate a typical car seat bag in 10–15 seconds. However, by running the motor for very short intervals, for example 0.4 seconds, and spacing the periods of energization by appropriate amounts, the desired total inflation of a bag can be achieved within the desired time interval of 1–10 minutes.

The invention offers the further advantage that if, for some reason, rapid inflation of the bag is required, this can readily be obtained simply by overriding the automatic control circuit, and running the pump continuously. Accordingly, if a particular driver wishes to cease using the pulsating inflation system and to set the pressure in one or more bags at some desired level to meet his particular needs for the time being, he can simply disable the automatic control system and run the appropriate pump or pumps until the desired degrees of inflation is produced.

The control circuit is preferably electronic and is preferably programmable to produce any desired pattern of pump energization. Accordingly, a standard pump may be used to supply bags of different size, and thus, if two bags of different volume are used within a seat, two identical pumps can be used to inflate the respective bags and the electronic control can be programmed to provide more inflating pulses to one bag than to the other in order to complete an inflation cycle. Further if it is desired to inflate both bags in equal lenghts of time the electronic control can readily set the interval between the pulses of energization to the respective pumps to be at different values so that complete inflation of both bags is produced in the equal time intervals.

Deflation of a fully inflated bag can be achieved either by venting the bag to atmosphere via a restrictor orifice to produce deflation in a particular time interval, or, more preferably, by venting the inflated bag via a solenoid valve which itself is opened under control of the electronic circuit. By energizing the solenoid valve for short, spaced apart intervals the period of deflation can be controlled in a manner similar to the period of inflation.

The above and further features and advantages of the invention will become clear from the following description of a preferred embodiment thereof, given by way of example only, reference being had to the accompanying drawing which schematically illustrates an embodiment of the invention for a seat incorporating two inflatable bags.

Referring to the drawing the bags 1, 2 are incorporated within a vehicle seat, the bag 2 being located in the lumbar region of the seat, and the bag 1 being located above the bag 2. Each bag is connected by means of tubing 3 to a respective electrically driven pump 4. The pumps 4 are substantially identical and may, for example, be substantially as described in our pending British application GB-A-2182398. Each lenght of tubing 3 incorporates a pressure switch 5 which acts as a safety cut out to disable the associated pump 4 when the pressure within the associated bag reaches a pre-set maximum and each pump has mounted on the outlet thereof a solenoid valve 6 which can be opened to vent the associated bag via the tubing 3 and the pump body.

The pumps 4 are connected to a control circuit 7 which is preferably an electronic control circuit, and which together with user operated switches 8, 9, 10 constitutes a control system for controlling bag inflation.

When a main mode control switch 9 is set to "PULSE" the electronic control circuit is operative to inflate the bags 1, 2 in alternation at a rate determined by a rate control switch 8. When one bag is being inflated, the other bag is being deflated via its associated solenoid valve 6, or is fully deflated, and vice versa, whereby PULSE operation produces alternating pressure zones in the lumbar and middle back regions of the seat user.

When the system is set in the PULSE mode the pump associated with the bag being inflated is not run continuously, but rather is automatically energized at spaced apart intervals whereby complete inflation of the bag is produced by a multiplicity of separate energizations of the pump. In a particular practical embodiment of the invention each energization of the pump lasts for approximately 0.4 seconds, and a total of 64 such energizations is required to charge either bag from a fully deflated state to a fully inflated state. The rate control 8 can be set by the user to produce time intervals between the beginning of each energization pulse of between 1 second and 10 seconds. If pulses are delivered at 1 second intervals the bag will be fully inflated in approximately 1 minute, and if pulses are delivered at 10 second intervals the bag will be fully inflated in approximately 10 minutes. The rate control may provide continuous variation of the rate at which pulses are delivered, or may provide a plurality of pre-set options.

After the appropriate number of energizations (64 in the case quoted above) of one pump, the electronic control starts to deliver energization pulses to the other pump. At the same time, the bag previously inflated is vented under circuit control either by opening the solenoid valve 6 to allow continuous venting of the bag, or by pulsing the solenoid valve open to produce a stepwise deflation of the bag.

In order to ensure that the PULSE operating cycle starts from a known bag configuration, the control circuit preferably causes both solenoid valves 6 to be opened for a predetermined period, e.g. 30 seconds when the system is first switched on. Preferably during this period neither pump is energized and accordingly at the end of the period both bags 1, 2 will be fully deflated. The inflation cycle can then commence from this known state.

It will be appreciated that because of the nature of the electronic control the number, duration, and frequency of pulses delivered to one pump may be different from that delivered to the other pump in accordance with the relative size of the bags, or any other desired operating criterion. For example, bags of different size may be used, but may be inflated to the same extent by varying the number of pulses in proportion to the volume of the inflated bag. Regardless of the number of pulses necessary to produce complete inflation, the bags may be inflated in the same or different time intervals by varying the frequency of the pulses.

In a particularly preferred embodiment of the invention the main mode selection switch 9 may be moved to an "OFF" position in which both bags are deflated, or to a "SUPPORT" position in which the upper bag 1 is deflated, and the lower bag 2 is inflatable or deflatable by the seat user using an INFLATE/DEFLATE control switch 10. Thus, if a particular user does not wish to use the PULSE mode he may either disable the system by setting the mode selection switch 9 to OFF, or he can move the mode selection switch 9 to SUPPORT and then inflate the lumbar support bag 2 as desired by moving the INFLATE/DEFLATE control to the INFLATE position to produce continuous running of the pump 4 until the desired degree of inflation is achieved. It will be appreciated that continuously running the pump 4 enables the bag 2 to be inflated to the desired degree quickly. When the INFLATE/DEFLATE switch is returned to its centre OFF position the pressure achieved within the bag 2 is held. In order to deflate the bag when the mode selection switch is in the SUPPORT position the INFLATE/DEFLATE switch is moved to its DEFLATE position to open solenoid valve 6 and permit continuous deflation of the bag.

If desired, the deflation of the bags, whether pulsed or continuous, may be produced by pumping air from the bags using a switchable deflation pump. Such deflation my also be under the control of the control circuit. A combined inflation/deflation pump may be used if desired.

We claim:

1. A seat bag inflation system comprising a seat structure and inflatable bag means forming part of said seat structure, electrically driven pump means for supplying inflation fluid to said bag means, said pump means when driven continuously producing complete inflation of said bag means in a first time interval, and a control circuit for automatically energizing said pump means for periods at spaced apart intervals to produce complete inflation of said bag means in a second time interval substantially longer than that which would be produced by continuous energization of said pump means, the duration of each period of energization being such that the output of said pump means during each period of energization produces only a small increase in the inflation of said bag means whereby a multiplicity of periods of energization at said spaced apart intervals is required to produce complete inflation of said bag means.

2. The seat bag inflation system according to claim 1 wherein the control circuit is a programmable electronic circuit and is programmable to produce a plurality of different pump means energization patterns whereby a common design of pump for said pump means may be used to inflate a plurality of different designs of said bag means.

3. The seat bag inflation system according to claim 1 wherein said system includes control means selectively operable by the user of the seat to vary the duration of the periods of pump means energization.

4. The seat bag inflation system according to claim 1 wherein said system includes means selectively operable by the user of the seat for overriding said control circuit, and means for thereafter placing operation of said pump means and inflation and deflation of said bag means under the direct control of said user.

5. The seat bag inflation system of claim 4 wherein said direct control means includes means for selectively permitting continuous energization of said pump means for rapid inflation of said bag means to a desired level and subsequent deenergization of said pump means.

6. The seat bag inflation system of claim 5, including valve means associated with said bag means for maintaining said bag means at said desired level of inflation upon deenergization of said pump means.

7. The seat bag inflation system according to claim 1 wherein said pump means includes a plurality of pumps and said bag means includes a plurality of bags, each of said pumps serving a respective bag or group of bags, and wherein said control circuit controls the plurality of pumps to co-ordinate inflation and deflation of the bags.

8. The seat bag inflation system according to claim 7 wherein two pumps are provided and the control circuit is operative to energize one pump at spaced apart intervals until the associated bag or bags attain a desired level of inflation, whereupon the control circuit is operative to energize the other pump at spaced apart intervals until the associated bag or bags attain a desired level of inflation.

9. The seat bag inflation system according to claim 8 wherein the control circuit is operative to produce deflation of the bag or bags associated with one pump whilst producing inflation of the bag or bags associated with the other pump.

10. The seat bag inflation system according to claim 8 or claim 9 wherein, upon switching on the system, the control circuit permits deflation of all bags for a predetermined period prior to the first inflation period.

11. The seat bag inflation system according to claim 1 wherein each period of pump energization at spaced apart intervals is of approximately equal lenght, said control circuit including means for selectively varying the lenght of said intervals between said periods for controlling the rate of inflation of said bag.

12. The seat bag inflation system according to claim 1 wherein said system includes control means selectively operable by the user of the seat to vary the frequency of the periods of pump means energization.

* * * * *